United States Patent [19]

Hendren

[11] Patent Number: 4,944,477

[45] Date of Patent: Jul. 31, 1990

[54] FOLDING TILTED BOTTLE HOLDER

[76] Inventor: Stephen R. Hendren, 13201 NW. 1st Ct., North Miami, Fla. 33168

[21] Appl. No.: 396,371

[22] Filed: Aug. 21, 1989

[51] Int. Cl.[5] ..... A47F 7/00

[52] U.S. Cl. ..... 248/150; 248/311.2

[58] Field of Search ..... 248/311.2, 463, 465, 248/460, 455, 456, 240.4, 150, 163.1, 148, 146, 311.3

[56] References Cited

U.S. PATENT DOCUMENTS

| | | | |
|---|---|---|---|
| 622,119 | 3/1899 | Clarke | 248/146 |
| 624,115 | 5/1899 | Steele | 248/240.4 X |
| 3,565,384 | 2/1971 | Lockwood | 248/146 X |
| 4,116,413 | 9/1978 | Anderson | 248/455 X |
| 4,515,334 | 5/1985 | Horne | 248/146 |
| 4,592,285 | 6/1986 | Egli | 248/455 X |
| 4,836,476 | 6/1989 | Wolf | 248/146 |

FOREIGN PATENT DOCUMENTS

| | | | |
|---|---|---|---|
| 156699 | 1/1954 | Australia | 40/152.1 |
| 642814 | 5/1964 | Belgium | 248/146 |

*Primary Examiner*—David L. Talbott

*Attorney, Agent, or Firm*—Alvin S. Blum

[57] ABSTRACT

A folding bottle holder holds a bottle in a tilted orientation with the neck up for storage in a refrigerator of bottles that are unsealed or too tall to fit between the shelves. A folding support member that supports the neck or shoulder of the bottle automatically folds flat when a bottle is removed and tilts up when a bottle is inserted. The mechanism includes a sliding carriage that engages the bottom of the bottle. This is operatively linked to the folding support member. Inserting the bottle slides the carriage in a first direction which pulls the support upright. Removing the bottle folds the support flat and that slides the carriage in a second direction, ready for repeating the process the next time a bottle is inserted.

5 Claims, 2 Drawing Sheets

FOLDING TILTED BOTTLE HOLDER

FIELD OF THE INVENTION

This invention relates to holders for bottles and more particularly to a holder that holds a bottle in tilted position with the neck elevated when in use and that folds flat when not in use.

BACKGROUND OF THE INVENTION

Wine racks are well known for storing unopened bottles of wine lying with the neck lowered so that bottle contents wet the cork. These racks ordinarily take form of supports that cradle the bottle at two locations along the bottle, one near the shoulder and the ather near or at the bottom of the bottle.

U.S. Pat. No. 4,515,334, issued to Horme, teaches a rack for a single bottle that may be used to store a bottle in the refrigerator with the unopened bottle in the neck-down position. It also provides for storing an opened bottle in the neck-up position tilted so that it can fit between the shelves of the refrigerator that are spaced so close together that there is not room for a bottle placed upright. The rack of horne includes a fixed indentation in a base for holding the bottom of the bottle and a fixed vertical support member with a neck-engaging notch for holding the neck up when the bottle is tilted in the neck-up position. The support has an aperture at its base for engaging the neck of the bottle in the neck down position. The fixed vertical support in combination with the elongate base makes the rack of Horne awkward to store when not in use. Furthermore, if a refrigerator shelf is above the rack of Horne, the fixed vertical support prevents insertion or removal of the bottle unless the rack is first pulled out from the refrigerator far enough to provide clearance for the bottle between the vertical support and the overlying shelf.

SUMMARY OF THE INVENTION

It is accordingly an object of the invention to provide a holder for holding a bottle in the refrigerator in a tilted position with the neck up to reduce leakage after seal has been broken with the bottle tilted enough so that it will fit between the shelves of the refrigerator. It is yet another object to provide a holder that will fold when not in use for convenience of storage, packing and shipping. It is yet another object to provide a holder that opens from its folded condition to its unfolded condition by the simple process of inserting the tilted bottle into the holder. It is yet another obfect to provide a holder that will fold flat when a bottle is removed for convenient access without removing the holder from the refrigerator.

The holder of the invention includes a flat base with shelf-engaging members depending therefrom; a carriage arranged to slide to and fro on said base, said carriage adapted to engage the bottom of the bottle; a neck support member rotatably attached at its bottom edge to the base, the support member arranged to rotate to a vertical position at right angles to the base with its upper edge adapted to engage the neck or shoulder of the bottle in the operating position. The support member is arranged to rotate to a horizontal position in the non-operating or storage position.

The sliding carriage is linked to the rotating support member so that engaging the carriage with the bottom of the bottle and forcing it to the rear of the refrigerator raises the support member to the vertical position for storing the bottle. And pulling the bottle forward, to remove it from the refrigerator, causes the bottle to rotate the support member forward to the horizontal position.

These and other objects, advantages and features of the invention will become more apparent when the following detailed description is read in conjunction with the drawings.

DETAILED DESCRIPTION OF THE PREFERRED EMBODIMENT

Figure 3:
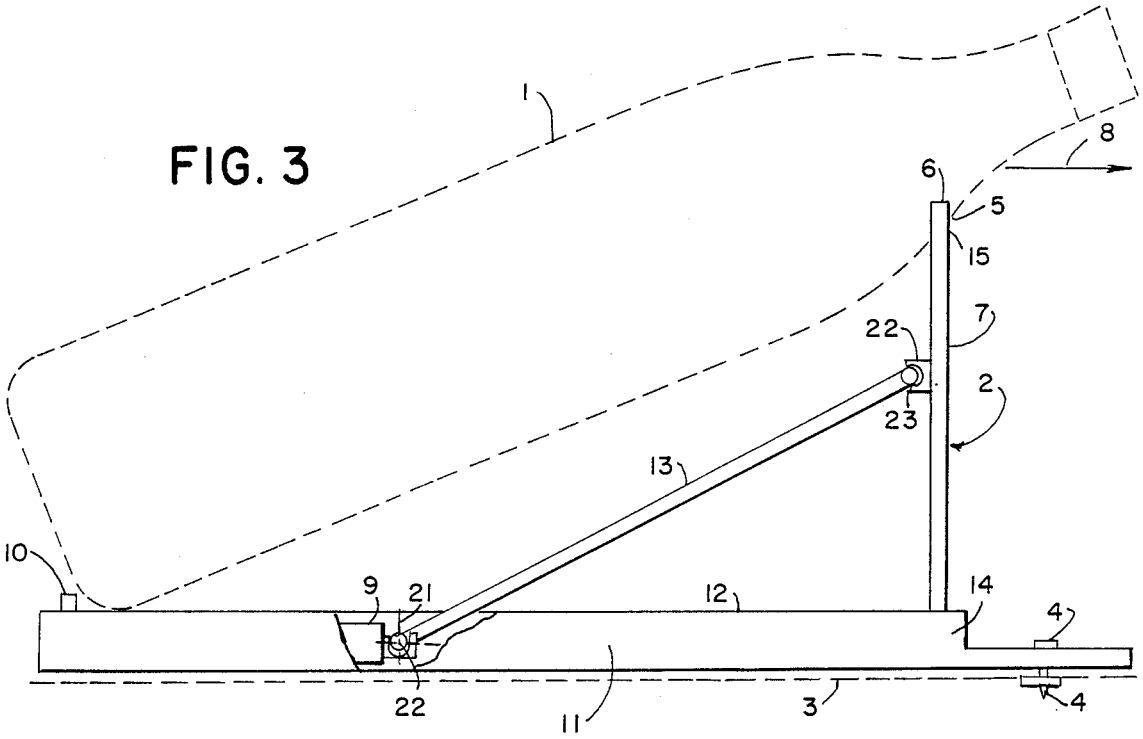
FIG. 3 is a side elevation view of the holder in operating condition.

Referring now first to FIG. 3, a partially filled bottle 1, shown in phantom, is resting securely in a tilted position in a holder 2 of the invention. The holder is attached to a wire shelf 3, shown in phantom, of a refrigerator by attachment means 4. The shoulder 5 of the bottle 1 is held in a recess 15 on the upper edge 6 of support member 7. The bottom of the bottle rests on a sliding carriage 9 against the vertical foot 10 extending up from the carriage.

The carriage 9 slides on base 11 between side rails 12. A portion of side rail 12 broken away to reveal carriage 9 and connecting rod 13 that connects carriage 9 to support 7. connecting rod 13 is hingedly connected to carriage 9 and support member 7. Support member 7 is pivotally connected to base 11 by hinge pins 14. The weight of the bottle prevents the carriage from sliding and the connecting rod prevents support member 7 from pivoting unless the carriage also moves.

Figure 1:
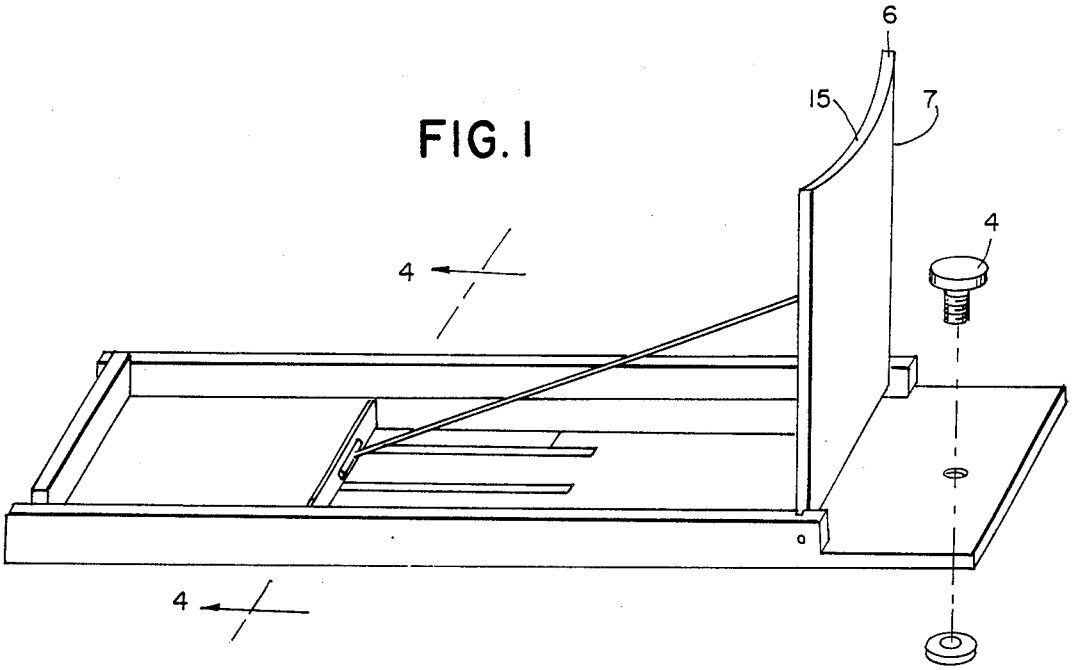
FIG. 1 is a perspective view of the holder in unfolded operating condition.
Figure 2:
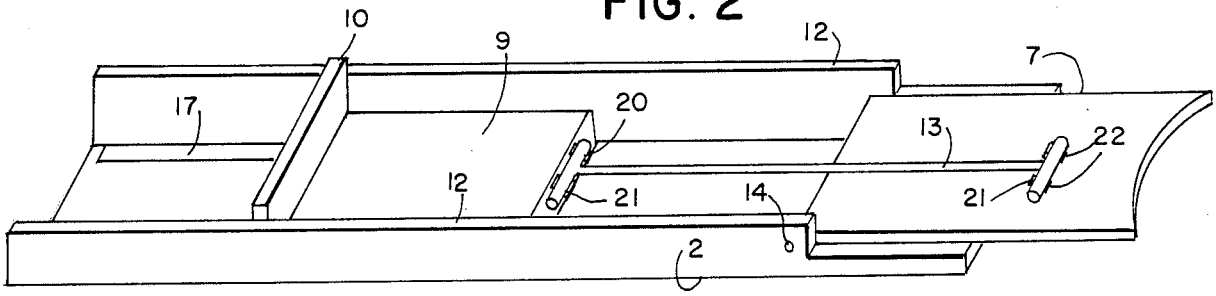
FIG. 2 is a perspective view of the holder in folded condition.
Figure 5:
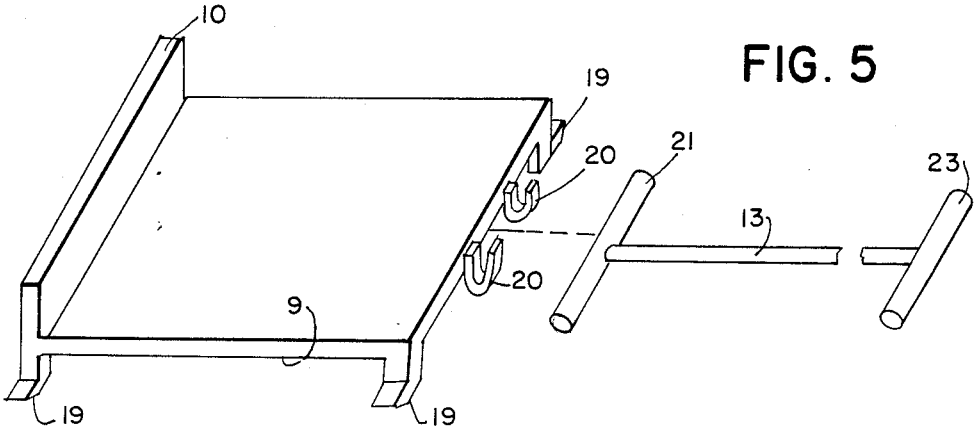
FIG. 5 is a perspective view of the carriage of the holder.
Figure 4:
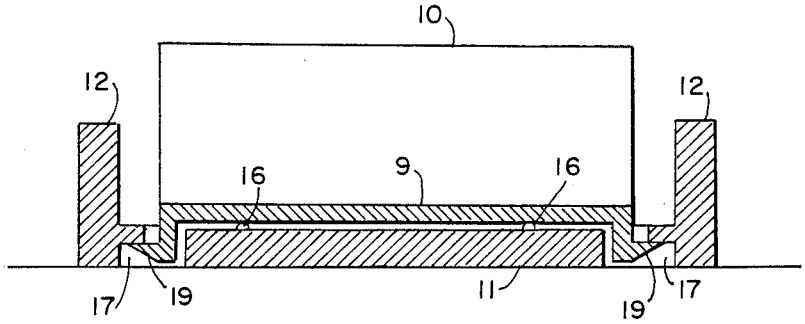
FIG. 4 is a sectional view through 4—4 of FIG. 1.

When the bottle is removed from the holder by pulling it in the direction of the arrow 8, the bottle forces support member 7 to rotate about pins 14 to the horizontal position shown in FIG. 2. This pulls the connecting rod 13 forward which pull carriage 11 forward to the configuration shown in FIG. 2 which is referred to as the folded flat or access condition. This flat condition leaves the front of the holder clear for insertion of a bottle, keeping in mind that the top of the holder may be blocked by an overlying shelf, not shown. This flat condition is also useful for storage or shipment. When a bottle is inserted into the holder, the bottom of the bottle is rested on the carriage against the upright foot 10 with the neck of the bottle tilted up. The bottle is then pushed toward the rear of the shelf, which causes the carriage 11 to slide to the rear, and connecting rod 13 to pull support member 7 up to the vertical position shown in FIG. 1. The upright support member 7 holds the neck or shoulder of the bottle in a recess 15 in its upper edge 6, with the bottle held in tilted position as shown in FIG. 3 that avoids leakage of an unsealed bottle. This also permits storage of bottles that are too tall to fit between the shelves. For economy of manufacture, carriage 9, base 11, support member 7 and connecting rod 13 may each be molded of plastic. As shown in FIGS. 4 and 5, carriage 9 rests atop tracks 16 on base 11 between side rails 12 that are a part of the base. Two longitudinal slots 17 in base 11 engage slot-engaging members 19 that extend below the body of the carriage and snap into place in the slots. This provides a captive sliding engagement of the carriage in the base so that it can slide between first and second conditions. Two "C" shaped hinge elements 20 are molded into the front edge of the carriage. The connecting rod 13 has two "T" shaped ends, one of which 21 snaps into the hinge elements 20 for a pivoting or hinging connection. The second end 23 of the connecting rod snaps into similar "C" shaped hinge elements 22 on the support member 7 as shown in FIGS. 2 and 3.

The carriage and support member are thus linked so that the support member is shifted between vertical and horizontal conditions by simple insertion and removal of the bottle. In the first, flat condition the holder is free of obstruction for removal or insertion of the bottle. In the second, or upright condition, a support securely holds the neck or shoulder tilted above the bottom of the bottle.

The above disclosed invention has a number of particular features which should preferably be employed in combination although each is useful separately without departure from the scope of the invention. While 2 have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. A folding bottle holder having two conditions, a first, flat condition for access and a second, upright condition for holding a bottle in a tilted orientation on a shelf with the neck of the bottle above the bottom of the bottle, said holder comprising:

(a) a sliding carriage means having bottom engaging means for engaging said bottom of said bottle;

(b) an elongate base member having a bottom surface, a top surface, two long opposed sides and two short opposed ends, a front end and a rear end, said bottom surface adapted for resting upon said shelf, said base member including carriage-engaging means for holding said carriage means on said top surface in slideable engagement for sliding between a first carriage position away from said rear end when said holder is in said first, flat condition and a second carriage position approximating said rear end when said holder is in said second, upright condition;

(c) a pivoting support member hving bottle support means for engaging the upper portion of said bottle and holding it above said bottom of said bottle in stable position when said holder is in said second, upright condition;

(d) pivot means pivotally connecting said support member to said base member, wherein said support member may be rotated between a substantially horizontal position when said holder is in said first, flat condition and a substantially vertical position when said holder is in said second, upright condition; and (e) connecting means operatively connecting said carriage means and said support member, said connecting means causing said support member to rotate to the vertical position as said carriage means slides from said first carriage position to said second carriage position upon action of the bottom of said bottle upon said bottom engaging means, and said connecting means further causing said carriage means to slide from said second carriage position to said first carriage position as said support member is rotated to the horizontal position by action of said uper portion of said bottle upon said support member during removal of said bottle.

2. The holder according to claim 1, in which said bottle support means is a recess in one edge of said support member.

3. The holder according to claim 1, in which said carriage engaging means includes elongate slots in said base member, said slots parallel to said long opposed sides and adapted for engaging slot engaging members extending from said carriage means.

4. The holder according to claim 1, in which said connecting means is an elongate member having two ends, a first end with a pivoting attachment means for attachment to said carriage means and a second end with a pivoting attachment means for attachment to said support member.

5. The holderr according to claim 1, in which said base member further includes shelf-engaging means for securing said base member to said shelf.

* * * * *